US006597372B2

(12) United States Patent
Huang

(10) Patent No.: US 6,597,372 B2
(45) **Date of Patent: *Jul. 22, 2003**

(54) TEMPORAL LIGHT MODULATION TECHNIQUE AND APPARATUS

(75) Inventor: Samson Huang, Saratoga, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/252,666

(22) Filed: Sep. 23, 2002

(65) Prior Publication Data

US 2003/0058263 A1 Mar. 27, 2003

Related U.S. Application Data

(63) Continuation of application No. 09/493,383, filed on Jan. 28, 2000, now Pat. No. 6,456,301.

(51) Int. Cl.[7] ..... G09G 5/00

(52) U.S. Cl. ..... 345/691; 345/690

(58) Field of Search ..... 345/690–693, 345/77, 84, 87, 89, 213, 210, 208

(56) References Cited

U.S. PATENT DOCUMENTS

| | | | | |
|---|---|---|---|---|
| 4,020,280 A | * | 4/1977 | Kaneko et al. | 348/797 |
| 5,202,674 A | * | 4/1993 | Takemori et al. | 345/75.1 |
| 5,233,340 A | * | 8/1993 | Yamaguchi et al. | 345/690 |
| 6,232,964 B1 | * | 5/2001 | Lee | 345/212 |
| 6,239,781 B1 | * | 5/2001 | Fujisawa | 345/691 |

* cited by examiner

*Primary Examiner*—Kent Chang
(74) *Attorney, Agent, or Firm*—Trop, Pruner & Hu, P.C.

(57) ABSTRACT

A method includes providing pulse width modulated signals. Each pulse width modulated signal is associated with a different bit, and the bits are arranged in an order to indicate an intensity of a pixel cell. Different frequencies are established for at least two of the pulse width modulated signals. Based on the logical states of the bits, the pulse width modulated signals are combined to form another signal, and the pixel cell is driven with this other signal.

16 Claims, 5 Drawing Sheets

400
TIME
TIME
TIME
TIME
TIME
TIME
TIME
TIME
P0 (VOLTS)
P1 (VOLTS)
P2 (VOLTS)
P3 (VOLTS)
P4 (VOLTS)
P5 (VOLTS)
P6 (VOLTS)
P7 (VOLTS)
ONE FRAME

Positive Frame
Negative Frame
Positive Frame
Negative Frame
401
P0 (VOLTS)
P1 (VOLTS)
P2 (VOLTS)
P3 (VOLTS)
P4 (VOLTS)
P5 (VOLTS)
P6 (VOLTS)
P7 (VOLTS)
TIME

TEMPORAL LIGHT MODULATION TECHNIQUE AND APPARATUS

This is a continuation of application Ser. No. 09/493,383, filed Jan. 28, 2000 now U.S. Pat. No. 6,456,301, entiled "TEMPORAL LIGHT MODULATION TECHNIQUE AND APPARATUS," granted on Sep. 24, 2002.

BACKGROUND

The invention generally relates to a temporal light modulation technique and apparatus.

Referring to FIG. 1, a silicon light modulator (SLM) 1 may include an array of LCD pixel cells 25 (arranged in rows and columns) that form corresponding pixels of an image. To accomplish this, each pixel cell 25 typically receives an analog voltage that controls the optical response of the pixel cell 25 and thus, controls the perceived intensity of the corresponding pixel. If the pixel cell 25 is a reflective pixel cell, the level of the voltage controls the amount of light that is reflected by the pixel cell 25, and if the pixel cell 25 is a transmissive pixel cell, the level of the voltage controls the amount of light that passes through the pixel cell 25.

There are many applications that may use the SLM 1. For example, a color projection display system may use three of the SLMs 1 to modulate red, green and blue light beams, respectively, to produce a projected multicolor composite image. As another example, a display screen for a laptop computer may include an SLM 1 along with red, green and blue color filters that are selectively mounted over the pixel cells to produce a multicolor composite image.

Regardless of the use of SLM 1, updates are continually made to the voltages of the pixel cells 25 to refresh or update the displayed image. More particularly, each pixel cell 25 may be part of a different SLM cell 20 (an SLM cell 20*a*, for example), a circuit that also includes a capacitor 24 to store a charge to maintain the voltage of the pixel cell 25. The SLM cells 20 typically are arranged in a rectangular array 6 of rows and columns. The charges that are stored by the SLM cells 20 typically are updated (via row 4 and column 3 decoders) in a procedure called a raster scan. The raster scan is sequential in nature, a designation that implies the SLM cells 20 of a row are updated in a particular order such as from left-to-right or from right-to-left.

As an example, a particular raster scan may include a left-to-right and top-to-bottom "zig-zag" scan of the array 6. More particularly, the SLM cells 20 may be updated one at a time, beginning with the SLM cell 20*a* that is located closest to the upper left corner of the array 6 (as shown in FIG. 1). During the raster scan, the SLM cells 20 are sequentially selected (for charge storage) in a left-to-right direction across each row, and the updated charge is stored in each SLM cell 20 when the SLM cell 20 is selected. After each row is scanned, the raster scan advances to the leftmost SLM cell 20 in the next row immediately below the previously scanned row.

During the raster scan, the selection of a particular SLM cell 20 may include activating a particular row line 14 (often called a word line) and a particular column line 16 (often called a bit line), as the rows of the SLM cells 20 are associated with row lines 14 (row line 14*a*, as an example) and the columns of the SLM cells 20 are associated with column lines 16 (column line 16*a*, as an example). Thus, each selected row line 14 and column line 16 pair uniquely addresses, or selects, a SLM cell 20 for purposes of transferring a charge (in the form of a voltage) from one of multiple signal input lines 12 to a capacitor 24 (that stores the charge) of the selected SLM cell 20.

As an example, for the SLM cell 20*a* that is located at pixel position (0,0) (in cartesian coordinates), a voltage may be applied to one of the video signal input lines 12 that indicates a new charge that is to be stored in the SLM cell 20*a*. To transfer this voltage to the SLM cell 20*a*, the row decoder 4 may assert (drive high, for example) a row select signal (called $ROW_0$) on a row line 14*a* that is associated with the SLM cell 20*a*, and the column decoder 3 may assert a column select signal (called $COL_0$) on the column line 16*a* that is also associated with the SLM cell 20*a*. In this manner, the assertion of the $ROW_0$ signal may cause a transistor 22 (of the SLM cell 20*a*) to couple a capacitor 24 (of the SLM cell 20*a*) to the column line 16*a*. The assertion of the $COL_0$ signal may cause a transistor 18 to couple one of the video signal input lines 12 to the column line 16*a*. As a result of these connections, the charge that is indicated by the voltage of the video signal input line 12 is transferred to the capacitor 24. The other SLM cells 20 may be selected for charge updates in a similar manner.

Typically, the pixel cell 25 is formed from a liquid crystal material. Because a conventional SLM may use precise, high voltages to achieve desired gray levels from the pixel cells 25, this high voltage requirement may be incapable with the low voltage trend of high speed digital processes, such as complementary metal-oxide-semiconductor (CMOS) processes, for example. Therefore, alternatively, some SLMs use binary voltage level pulse width modulation (PWM), a technique in which pulse width modulated signals are applied to the pixel cells.

The voltage of the pulse width modulated signal alternates between two levels: a logic one level and a logic zero level and thus, the pixel cell is either turned fully on or fully off by this signal. However, the duty cycle (the ratio of the time in which the signal has a logic one voltage level to the time in which the signal has a logic zero voltage level, for example) of the pulse width modulated signal is controlled to achieve the appearance of a gray level temporally. Thus, by using the PWM technique, precise high voltages are not used. Unfortunately, the PWM technique may require a high modulation speed and may cause excessive power to be dissipated.

Thus, there is a continuing need for an arrangement that addresses one or more of the problems that are stated above.

DETAILED DESCRIPTION

Figure 1:
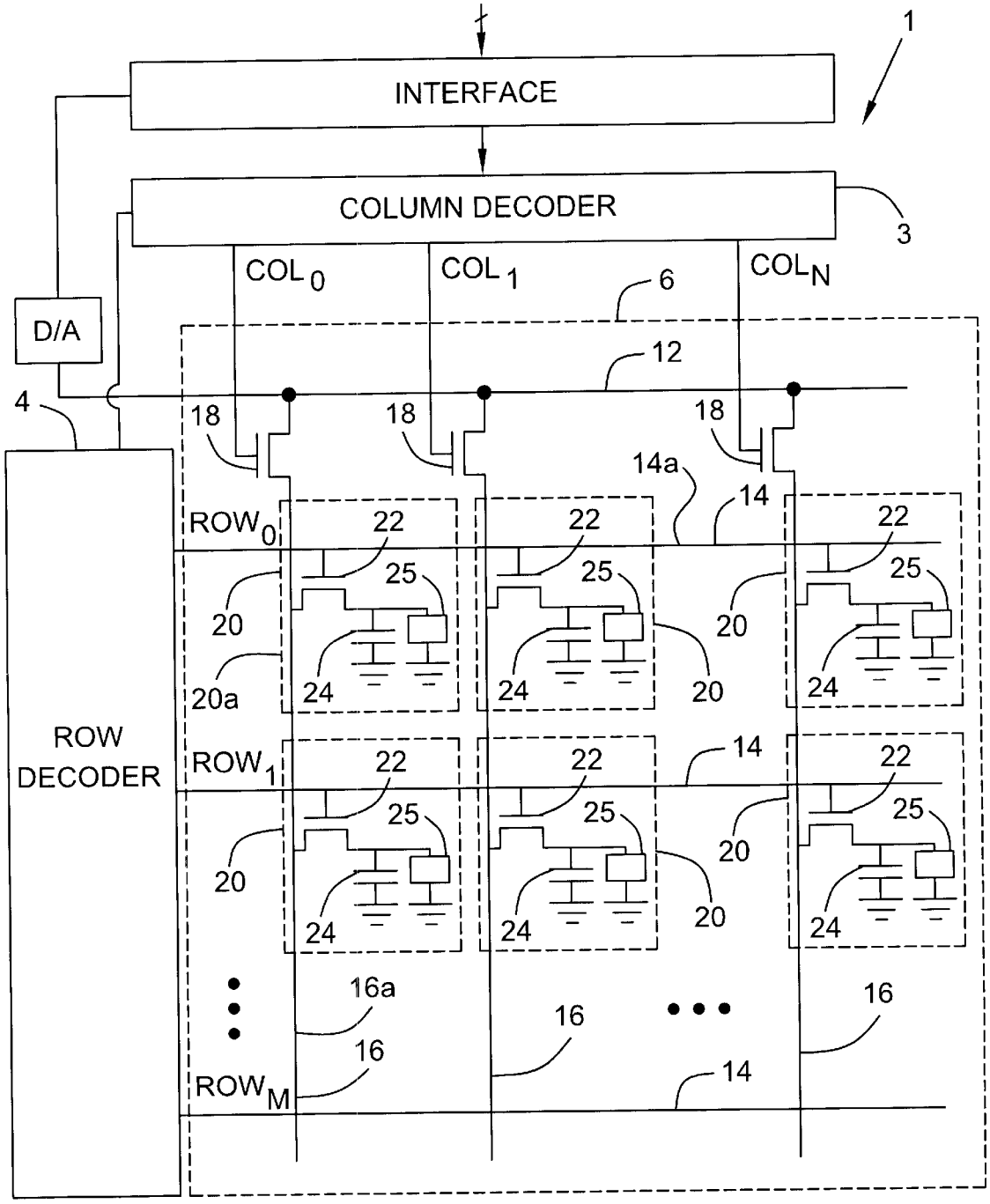
FIG. 1 (PRIOR ART)
FIG. 1 is a schematic diagram of a silicon light modulator (SLM) according to the prior art.
Figure 2:
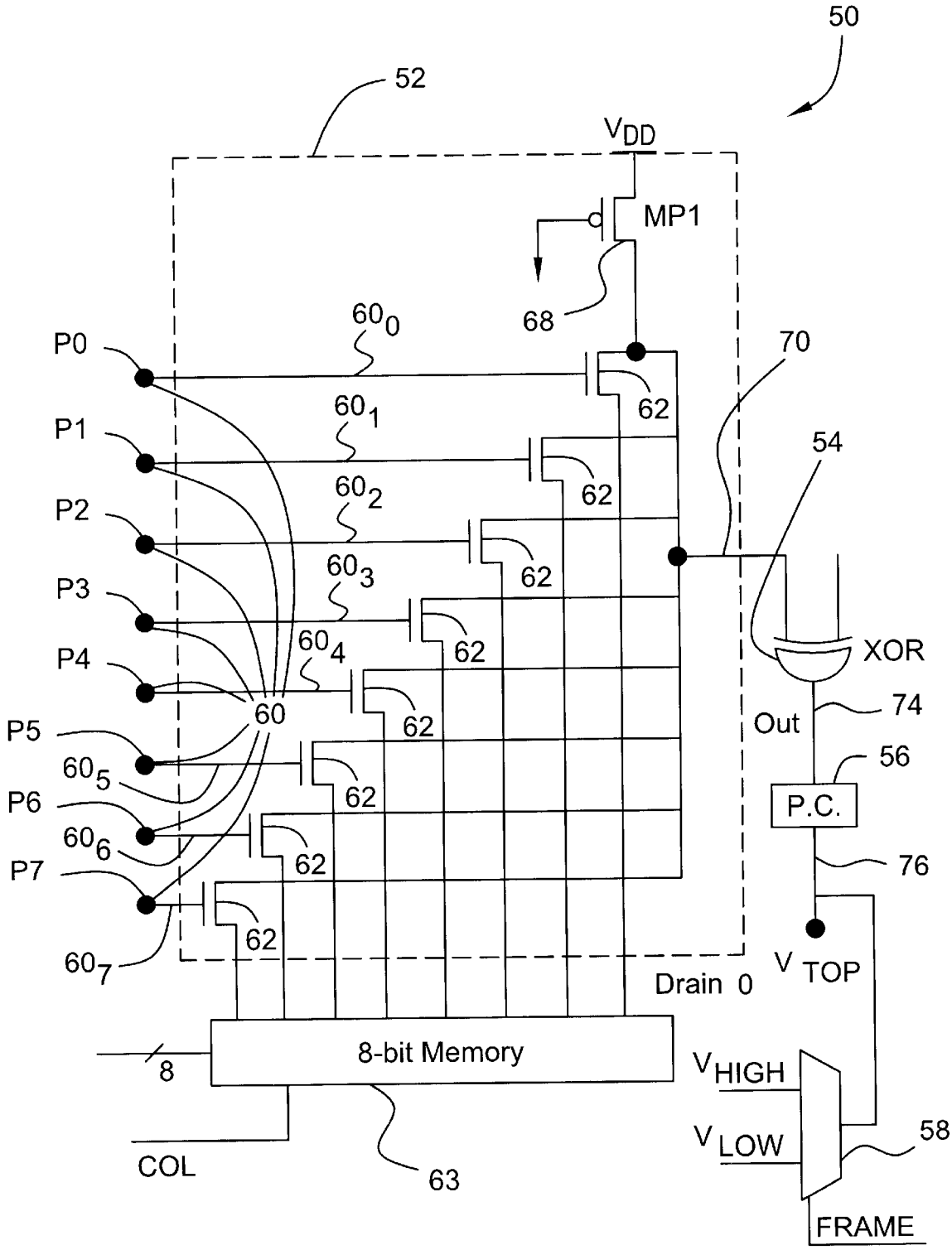
FIG. 2 is a schematic diagram of a modulator cell according to an embodiment of the invention.

Referring to FIG. 2, an embodiment 50 of a silicon light modulator (SLM) cell 50 in accordance with the invention includes a pixel cell 56 (a liquid crystal cell, for example) that receives a voltage to control the optical response of the pixel cell 56. For purposes of establishing a design that is compatible with a digital fabrication process (a complementary metal-oxide-semiconductor (CMOS) process, for example), the SLM cell 50 includes circuitry that combines globally generated pulse width modulated (PWM) signals (called P0, P1, P2, P3, P4, P5, P6 and P7) to set a pixel intensity of the pixel cell 56. The P0–P7 signals have duty cycles that are binarily weighted with respect to each other and are selectively combined by the SLM cell 50 to control the optical response of the pixel cell 56, as described below.

More particularly, a particular display may include numerous SLM cells 50, each of which receives the same globally generated P0–P7 signals and combines the P0–P7 signals based on a value that is stored in an eight bit memory 63 (an eight bit register, for example) of the SLM cell 50 to set a pixel intensity that is associated with the SLM cell 50. To accomplish this, in some embodiments of the invention, the SLM cell 50 includes the memory 63, an eight input NOR gate 52 and an XOR gate 54 that interact as described below. The memory 63 stores an eight bit value that indicates a gray level (a gray level from 0 to 255, for example) for the pixel cell 56 and is used to control the response of the NOR gate 52. In this manner, the NOR gate 52 includes eight input terminals 60 (terminals $\mathbf{60}_0$, $\mathbf{60}_1$, . . . $\mathbf{60}_7$, as examples), each of which receives a different one of the P0–P7 pulse width modulated signals. Each input terminal 60 is associated with a different bit of the memory 63 and is enabled or disabled by the associated bit. The NOR gate 52 combines the pulse width modulated signals that are received by the input terminals 60 that are enabled to form a signal (at an output terminal 70 of the NOR gate 52) that is used to drive the pixel cell 56, as described below. The SLM cell 50 may be one of several SLM cells so that collectively form frames of an image, and the value that is stored in the memory 63 may be updated for each frame.

Referring also to FIGS. 3, 4, 5, 6, 7, 8, 9 and 10, as noted above, the P0–P7 pulse width modulated signals have duty cycles that are binarily weighted with respect to each other. For example, the P7 signal (that is received by the input terminal $\mathbf{60}_7$) has a duty cycle of ½; the P6 signal (that is received by the input terminal $\mathbf{60}_6$) has a duty cycle of ¼; the P5 signal (that is received by the input terminal $\mathbf{60}_5$) has a duty cycle of ⅛; the P4 signal (that is received by the input terminal $\mathbf{60}_4$) has a duty cycle of 1/16; the P3 signal (that is received by the input terminal $\mathbf{60}_3$) has a duty cycle of 1/32; the P2 signal (that is received by the input terminal $\mathbf{60}_2$) has a duty cycle of 1/64; the P1 signal (that is received by the input terminal $\mathbf{60}_1$) has a duty cycle of 1/128; and the P0 signal (that is received by the input terminal $\mathbf{60}_0$) has a duty cycle of 1/256.

As shown, the active time intervals (i.e., the time intervals in which the pulse width modulated signals have a logic one state) of the P0–P7 pulse width modulated signals do not overlap. Therefore, the active time interval of the signal that is provided by the output terminal of the NOR gate 52 is the sum of the active time intervals of the P0–P7 signals that are received by the input terminals 60 that are enabled. Thus, because the value that is stored in the memory 63 controls which input terminals 60 are enabled, this value controls the perceived gray level of the pixel cell 56.

For example, if the memory 63 stores a value that indicates "00000000"b (wherein the suffix "b" denotes a binary representation), none of the P0–P7 signals contribute to the signal at the output terminal 70 of the NOR gate 52, and as result, the output terminal 70 has a logic zero level. As another example, if the value stored by the memory 63 indicates "1111111"b, all of the input terminals 60 are enabled, and thus, the output terminal 70 furnishes a signal that has a duty cycle of one (i.e., the output terminal 70 indicates a logic one signal), as all of the P0–P7 signals contribute. As yet another example, when the memory 63 stores a value that indicates "10010000"b, all of the input terminals 60 are disabled except for the input terminals $\mathbf{60}_7$ and $\mathbf{60}_4$, a configuration that causes the signal at the output terminal 70 to have a duty cycle equal to 9/16: the sum of the duty cycles of the P7 and P4 signals.

In some embodiments, the signal furnished by the output terminal 70 of the NOR gate 52 is not used to directly drive the pixel cell 56. Instead, the SLM cell 50 includes intervening circuitry to ensure permanent disorientation of the liquid crystal material of the pixel cell 56 does not occur. In this manner, if the bias voltage across the liquid crystal material of the pixel cell 56 does not periodically change polarity, permanent disorientation of the liquid crystal material may occur. For purposes of preventing this from occurring, in some embodiments, the SLM cell 52 may include the XOR gate 54 and a multiplexer 58 to cause the bias voltage across the pixel cell 56 to change polarity from frame to frame.

The XOR gate 54 includes one input terminal that is connected to the output terminal 70, and another input terminal of the XOR gate 54 receives a signal called FRAME. The FRAME signal indicates whether the current frame is a positive frame or a negative frame, a designation that is used to label the current polarity of the bias voltage across the pixel cell 56. The output terminal of the XOR gate 54 is coupled to one plate of the pixel cell 56, and the other plate of the pixel cell 56 is coupled to the output terminal of the multiplexer 58. The select input terminal of the multiplexer 58 receives the FRAME signal.

Due to this arrangement, the XOR gate 54 and the multiplexer 58 operate in the following manner. For a positive frame, the FRAME signal is asserted (driven high, for example), an event that causes the multiplexer 58 to furnish a logic zero voltage to the plate (of the pixel cell 56) that is coupled to the output terminal of the multiplexer 58. Furthermore, when the FRAME signal is asserted, the XOR gate 54 routes the signal from the output terminal 70 of the NOR gate 52 to the plate that is coupled to the output terminal of the XOR gate 54. Thus, this above-described orientation establishes a bias in one direction across the plates of the pixel cell 56. During a negative frame, the FRAME signal is de-asserted (driven low, for example), an event that causes the multiplexer 58 to furnish a logic one voltage to the plate that is connected to its output terminal and causes the XOR gate 54 to invert the signal that is furnished by the output terminal 70 before routing the inverted signal to the other plate of the pixel cell 56. Thus, this scheme inverts the voltage across the pixel cell 56, and the bias voltage across the pixel cell 56 is alternated between positive and negative frames.

In some embodiments of the invention, the NOR gate 52 may include n-channel metal-oxide-semiconductor field-effect-transistors (NMOSFETs) 62, each of which has its gate terminal coupled to one of the input terminals 60 and its source terminal coupled to the bit (of the memory 63) that is associated with the input terminal 60 to which the NMOSFET 62 is coupled. The drain terminals of the NMOSFETs 62 are coupled together to form the output terminal 70. The NOR gate 52 also includes a p-channel metal-oxide-semiconductor field-effect-transistor (PMOSFET) 68 that has its source terminal coupled a positive voltage level (called $V_{DD}$) and its drain terminal coupled to the output terminal 70.

Figures 3, 4, 5, 6, 7, 8, 9, 10:
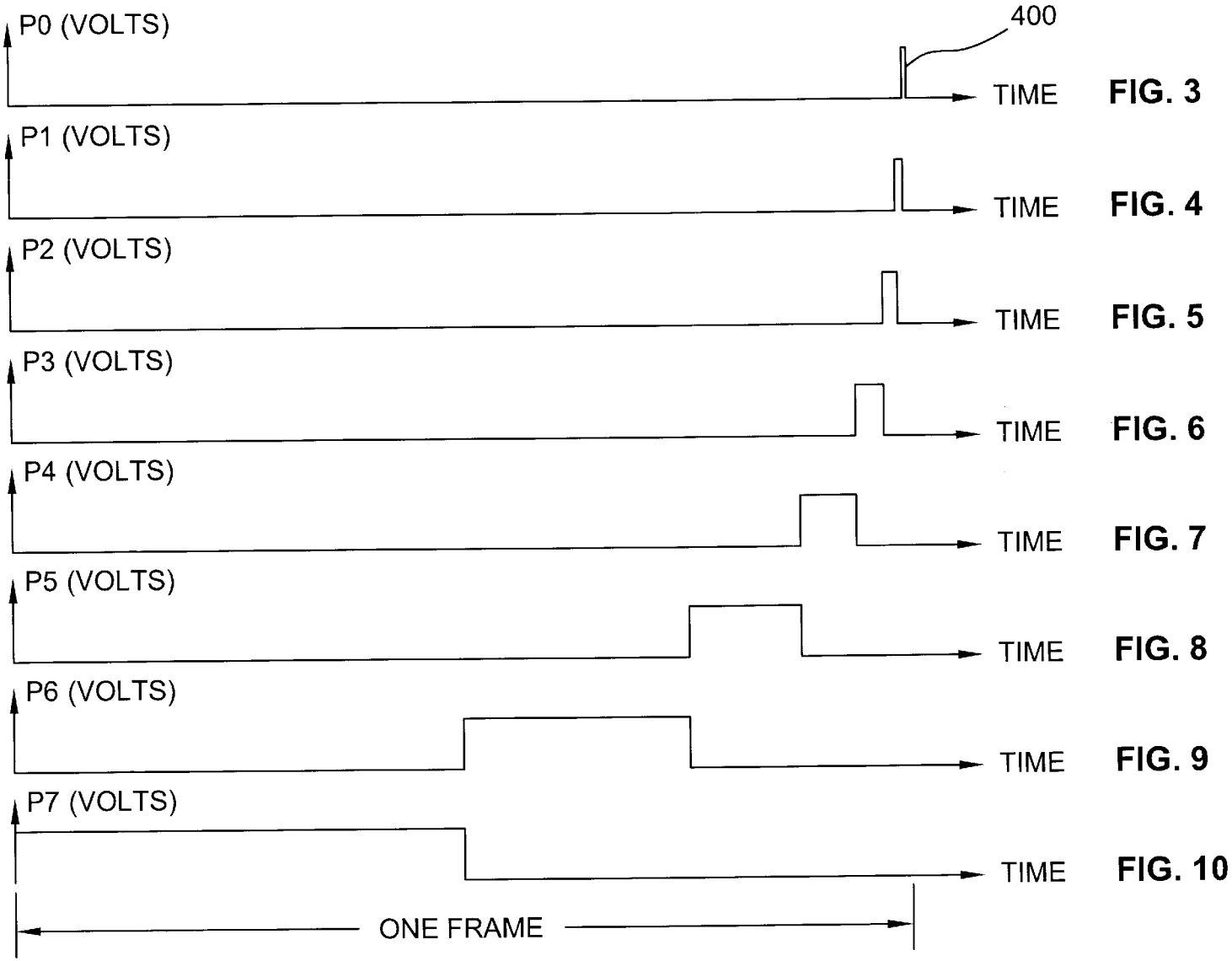
FIGS. 3, 4, 5, 6, 7, 8, 9 and 10 are waveforms of signals that may be received by logic of the modulator cell of FIG. 2 according to an embodiment of the invention.
Figures 11, 12, 13, 14, 15, 16, 17, 18:
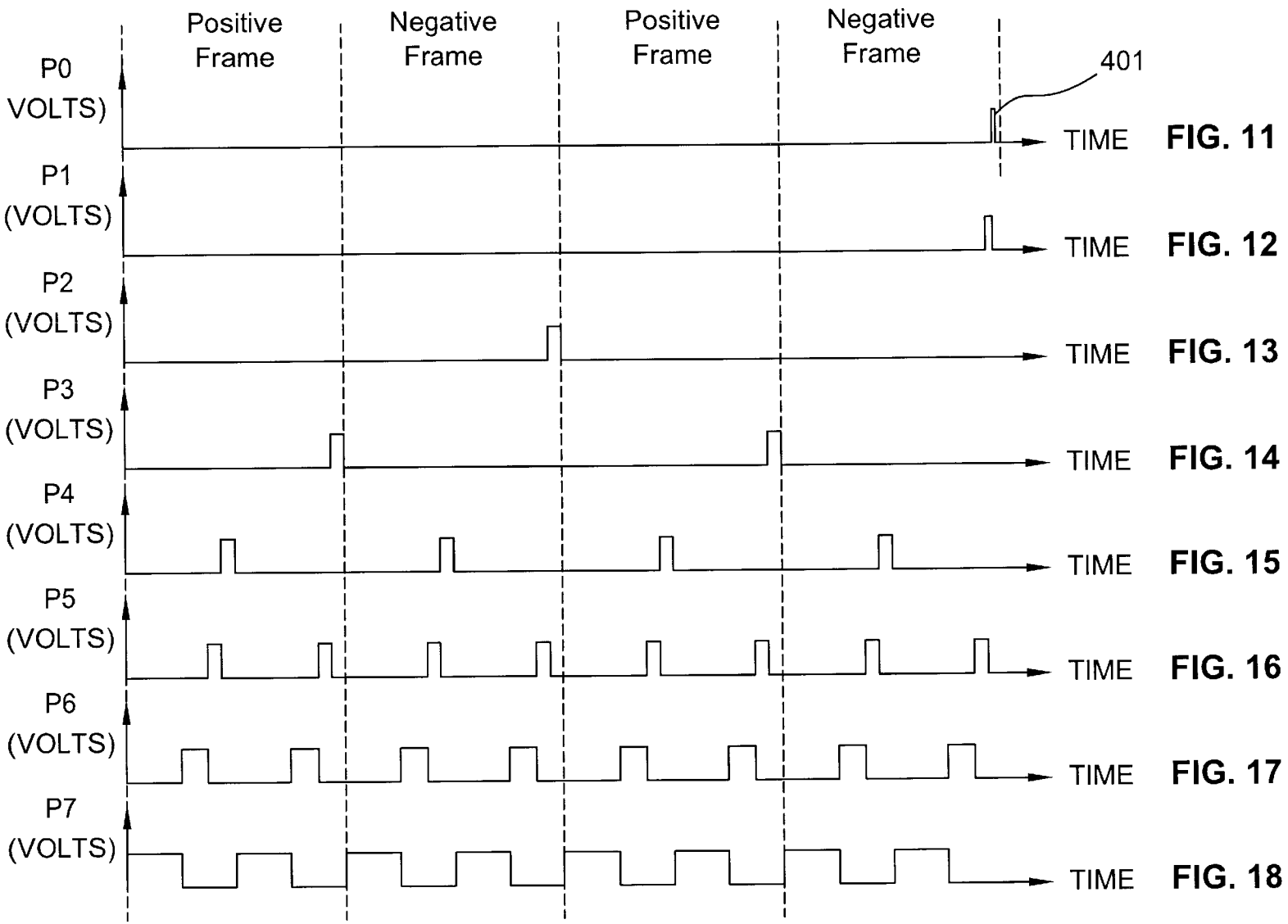
FIGS. 11–18 are waveforms of signals that may be received by input terminals of logic of the display unit of FIG. 2 according to an embodiment of the invention.

The P0–P7 pulse width modulated signals that are depicted in FIGS. 3–10 may be replaced, in some embodiments, by the P0–P7 pulse width modulated signals that are depicted in FIGS. 11–18, respectively. The P0–P7 signals of FIGS. 3–10 may solve two problems that may be encountered with the use of the P0–P7 signals that are depicted in FIGS. 3–10. First, the frequency at which the bias voltage of the pixel cell 56 is inverted should be approximately 60 Hz, a frequency that sets the period of each frame to be 16.67 milliseconds (ms). Thus, the time in which the P0 signal of FIG. 3 is high (represented by the pulse 400) is approximately 1/256th of that, or 65 μs, a time that may be too short for the liquid crystal material of the pixel cell 56. Second, the pulse width modulated signals (such as the P7 pulse width modulated signal, for example) of FIGS. 3–10 that are associated with the more significant bits of the memory 63 are toggling at a fairly low frequency, a condition that may generate undesired visual artifacts.

As shown in FIGS. 11–18, the overall cycle time of the P0–P7 signals are extended to four times of the frame period time to address the first problem, and for the same inverting frequency of 60 Hz, the active period of the P0 signal (represented by the pulse 401 in FIG. 11) is increased to 260 μs. To minimize the second problem, the P4, P5, P6 and P7 signals (that are associated with the more significant bits that are stored in the memory 63) have a higher frequency than the P0, P1, P2, and P3 signals, but still maintain the same duty cycle as before. As shown in FIGS. 11–14, the P3 signal is updated every other frame; and the P2–P0 signals are updated once every four frames. Thus, there is tradeoff, as intensity updates that are associated with lesser significant bits occur at a lower frame rate. However, the intensity updates that are associated with the more significant bits occur more often, as these updates are more visually noticeable.

Figure 19:
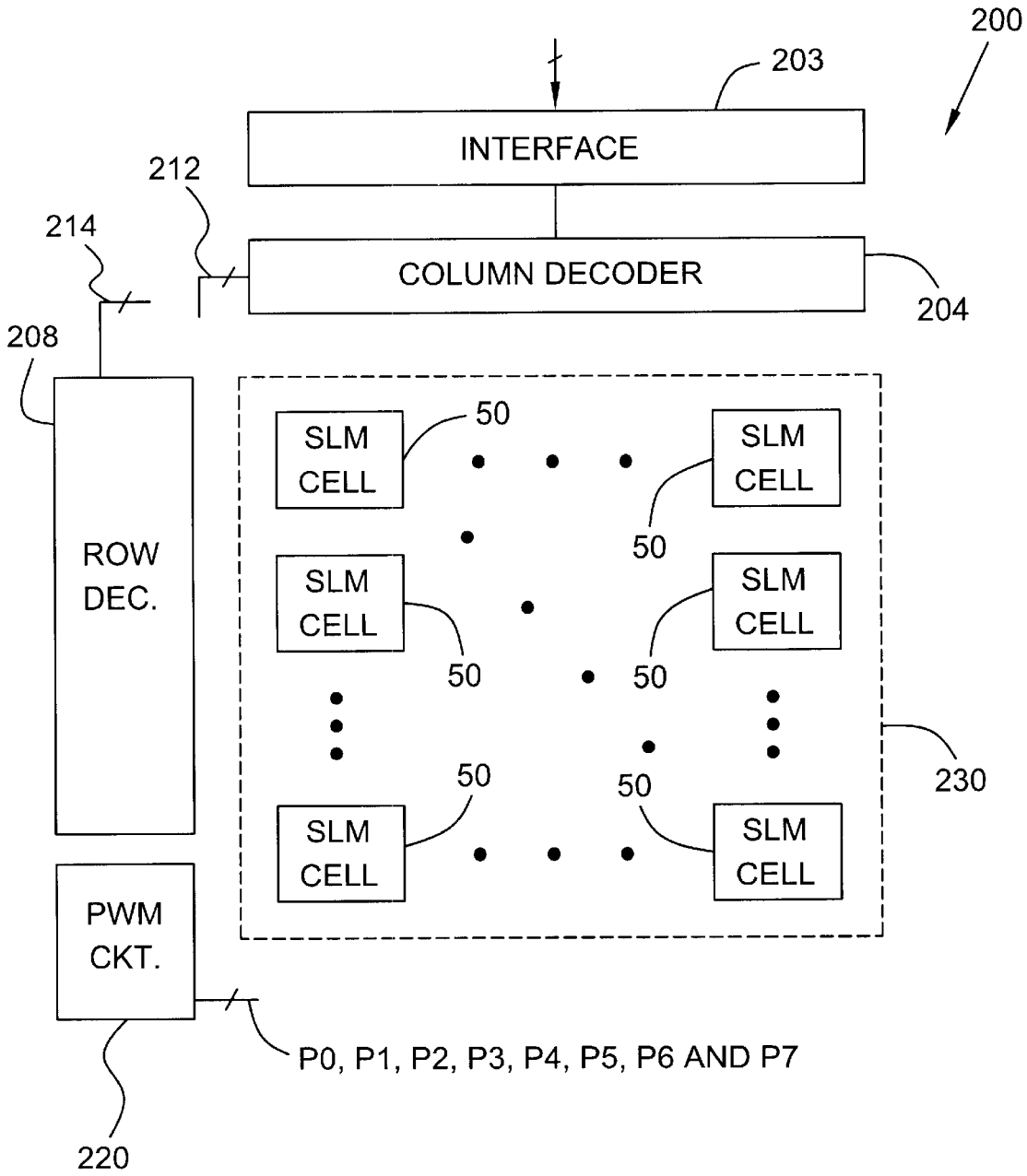
FIG. 19 is a schematic diagram of a silicon light modulator according to an embodiment of the invention.

Referring to FIG. 19, in some embodiments, the SLM cell 50 may be used in an SLM 200 and may be one of several SLM cells 50 that form an array 230 and are arranged in rows and columns. The SLM 200 may also include a pulse width modulation circuit 220 to generate the P0–P7 pulse width modulated signals (as described above) globally for all of the SLM cells 50. In this manner, each SLM cell 50 receives the globally generated P0–P7 pulse width modulated signals and uses the value stored in the memory 63 of the SLM cell 50 to combine the P0–P7 pulse width modulation signals locally to set the pixel intensity of its pixel cell 56.

In some embodiments of the invention, the SLM 200 may include a row decoder 208 that includes control lines 214 to select a particular row of SLM cells 50 for raster scan updates or a refresh operation, and the SLM 200 may include a column decoder 204 that includes control and data lines 212 to update the memories 63 of a group of the SLM cells 50 of a particular row. In this manner, the column decoder 204 may receive new frame data via an external interface 203. In some embodiments, to perform a raster scan, the row decoder 208 may select the SLM cells 50 one row at a time. For each selected row, the column decoder 204 selects a group of the SLM cells 50, updates the memories of the selected group of SLM cells 50 and continues this process until the memories of all of the SLM cells 50 of the selected row have been updated. Other arrangements are possible.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method comprising:

providing pulse width modulated signals;

establishing different frequencies for at least two of the pulse width modulated signals; and driving a pixel cell with a combination of the pulse width modulated signals.

2. The method of claim 1, wherein each pulse width modulated signal is associated with a different bit of a value indicative of an intensity of the pixel cell.

3. The method of claim 2, wherein the establishing different frequencies comprises:

establishing a lower frequency for one of the pulse width modulated signals that is associated with one of the bits that has a lower order; and establishing a higher frequency for one of the pulse width modulated signals that is associated with one of the bits that has a higher order.

4. The method of claim 2, wherein the establishing different frequencies comprises:

establishing lower frequencies for the pulse width modulated signals that are associated with bits that have lower orders; and establishing higher frequencies for the pulse width modulated signals that are associated with bits that have higher orders.

5. The method of claim 1, the pulse width modulated signals have different duty cycles.

6. The method of claim 5, wherein the duty cycles are binarily weighted with respect to each other.

7. An apparatus comprising:

a pixel cell;

a first circuit to provide pulse width modulated signals, at least two of the pulse width modulated signals having different frequencies; and a second circuit to combine the pulse width modulated signals to drive the pixel cell.

8. The apparatus of claim 7, wherein each of the pulse width modulated signals is associated with a bit of a value indicative of an intensity of the pixel cell.

9. The apparatus of claim 8, wherein the first circuit establishes a lower frequency for one of the pulse width modulated signals that is associated with one of the bits that has a lower order and establishes a higher frequency for one of the pulse width modulated signals that is associated with one of the bits that has a higher order.

10. The apparatus of claim 8, wherein the first circuit establishes lower frequencies for the pulse width modulated signals that are associated with bits that have lower orders and establishes higher frequencies for the pulse width modulated signals that are associated with bits that have higher orders.

11. The apparatus of claim 7, wherein the pulse width modulated signals have different duty cycles.

12. The apparatus of claim 11, wherein the duty cycles are binarily weighted with respect to each other.

13. A method comprising:

providing pulse width modulated signals to indicate different bits of an intensity value for a pixel cell;

using a first set of the pulse width modulated signals to update the pixel cell at a first rate; and using a second set of the pulse width modulated signals to update the pixel cell at a second rate different from the first rate.

14. The method of 13, wherein the first set of pulse width modulated signals is associated with lesser significant bits of the value and the second set of pulse width modulated signals is associated with higher significant bits of the value.

15. The method of claim 14, wherein the pulse width modulated signals of the first set have lower frequencies and the pulse width modulated signals of the second set have higher frequencies.

16. The method of claim 13, wherein the bits are binarily weighted with respect to each other.

* * * * *